United States Patent [19]

Morlock

[11] Patent Number: 4,573,405

[45] Date of Patent: Mar. 4, 1986

[54] CAN CRUSHING MACHINE

[76] Inventor: Ruben D. Morlock, Western Park Village, Jamestown, N. Dak. 58401

[21] Appl. No.: 632,598

[22] Filed: Jul. 19, 1984

[51] Int. Cl.[4] ..... B30B 9/32

[52] U.S. Cl. ..... 100/157; 100/49; 100/902; 241/228

[58] Field of Search ..... 100/49, 157, 902; 241/99, 228; 99/574

[56] References Cited

U.S. PATENT DOCUMENTS

| | | | |
|---|---|---|---|
| 49,088 | 8/1806 | Crever . | |
| 373,342 | 11/1887 | Cornelius . | |
| 410,879 | 9/1889 | Cornelius . | |
| 1,655,333 | 1/1928 | Perazio . | |
| 2,356,122 | 8/1944 | Edward . | |
| 2,365,122 | 12/1944 | Taylor . | |
| 2,619,150 | 11/1952 | Smith . | |
| 2,682,832 | 7/1954 | Lohre et al. | 100/157 |
| 2,877,723 | 3/1959 | Decker . | |
| 2,887,723 | 5/1959 | Hallie et al. . | |
| 3,036,517 | 5/1962 | Malarsky | 100/233 |
| 3,749,004 | 7/1973 | Pagdin et al. | 100/50 |
| 3,776,128 | 12/1973 | Morris | 100/53 |
| 3,814,009 | 6/1974 | Davis, Jr. et al. | 100/159 |
| 3,827,351 | 8/1974 | Rosenow | 100/176 |
| 3,827,355 | 8/1974 | Hamisch, Sr. . | |
| 4,121,514 | 10/1978 | Nickaioff | 100/91 |
| 4,444,100 | 4/1984 | Newman | 100/157 |

FOREIGN PATENT DOCUMENTS

| | | |
|---|---|---|
| 1196535 | 5/1958 | France . |
| 209857 | 1/1924 | United Kingdom . |
| 301242 | 11/1928 | United Kingdom . |

*Primary Examiner*—Timothy F. Simone
*Attorney, Agent, or Firm*—Kinney & Lange

[57] ABSTRACT

A can crushing apparatus has an outer, bottomless drum housing, which is tubular and mounted on rollers to be freely rotatable, and a central inner roller which is mounted on the interior of the tubular drum, is urged against one side wall of the drum, and is power driven. Cans to be crushed are guided on a suitable guide into a nip between the roller and the outer drum, and are crushed as they pass between the roller and drum under spring load. Crushed cans will drop through the open bottom of the drum into a collecting bin or sack.

11 Claims, 5 Drawing Figures

CAN CRUSHING MACHINE

BACKGROUND OF THE INVENTION

1. Field of the Invention

The present invention relates to rotary drum crushers for cans.

2. Description of the Prior Art

Rotary drum can crushers have been known. For example the U.S. Pat. No. 4,444,100 for a Can Crushing Machine shows an outer drum and a roller within the drum. The outer drum has a drive ring around its outer periphery, and the inner drum or roller is an idler. In the quest to make the can crushers small, low cost, quiet in operation and reliable, so that the crushers can be used for individual installations in restaurants, bars, and other places where beverages are served in cans, certain improvements were deemed desirable.

Rotary flour mills are shown in U.S. Pat. Nos. 373,342 and 410,879. In these particular patents, there are a pair of interfitting (one inside the other) crushing rolls mounted in a particular manner to permit crushing grain into flour, and which use heavy rolls that are powered driven. In U.S. Pat. No. 410,879, a spring load is placed upon the center roll relative to the outer drum, and in boh patents material is carried between the outer drum and the inner roller for a grinding and crushing action. After grinding the material is discharged. These old flour mills include means for removing the material after it has been crushed and ground, and comprise substantial size machines that are driven by belts from remotely located motors.

U.S. Pat. No. 1,655,333 to V. S. Perazio, issued Jan. 3, 1928 shows a fruit crusher and squeezer that is hand operated and provides a drive on an outer drum that had a spring loaded inner roller that crushes the fruit as it moves against, or adjacent to, the inner surface of the outer drum.

U.S. Pat. No. 49,088, issued Aug. 1, 1865 to Crever and Keeney for a cider mill shows a unit that crushes fruit using an outer drum and an inner roller with outer roller guides for holding the outer drum for rotation, and a hand powered drive to the outer drum comprising a ring gear and pinion.

U.S. Pat. No, 2,619,150, issued Nov. 25, 1952 to Smith shows a type of can crushing mechanism that has oscillating jaws that clamp together to crush cans being introduced.

British Pat. No. 301,242, issued in November of 1928 to Torulf shows a kneading, crushing, mixing or other type machine using a pair of rotating members, including a inner roller that rotates within an outer drum or housing. The unit is hand driven, and the inner roller is an idler roller which can be resiliently mounted relative to the outer drum to permit materials to pass between the roller and the outer housing.

British Pat. No. 209,857, issued January 1924 to Seaman also shows a grinding, crushing or mixing mill that has an outer conical housing that is power driven and an inner truncated conical member with the surfaces of the two members cooperating together for working materials that pass between the conical members.

French Pat. No. 1,196,535, issued November of 1959 to Tamani shows a fruit squeezer that has two squeezing chambers, each of which has an outer cylindrical drum member having an inner roller mounted therein with the fruit being passed between the two members as the outer members are driven, for squeezing the fruit and removing juices and pulp.

The use of large machines for crushing and compacting cans is illustrated in U.S. Pat. No. 3,749,004, issued July 31, 1973 to Pagdin et al.

U.S. Pat. No. 3,776,128, issued Dec. 4, 1973 to Morris utilizes a conveyor to move cans from a hopper to a jaw mechanism which partially collapses the cans, and the cans then fall into a pair of counterrotating rollers that further compresses them.

U.S. Pat. No. 2,877,723, pertains to a garbage and refuse incinerator utilizing interfitting conically shaped crushing members having corrugated surface characteristics to crush incombustible waste materials deposited into the residue receiver from a combustion area.

Conical discs used for crushing cans are shown in U.S. Pat. No. 2,356,122 and U.S. Pat. No. 3,036,517 relates to a can crusher having a stationary crushing plate and a movable crushing plate driven by an eccentric cam to perform a crushing operation.

U.S. Pat. No. 3,827,351, discloses a crusher which utilizes a pair of rollers having a substantially square cross section with rounded edges to form the crusher elements. Special gearing and power trains are required to rotate the rollers out of phase and keep them synchronized.

SUMMARY OF THE INVENTION

The present invention relates to a compact, low cost, easily serviced can crusher that can be used on an individualized basis in stores, bars, restaurants and the like. In order to accomplish this, the unit is made very compact, and includes a frame that has an outer, open ended tube forming a tubular drum (both ends are open) mounted on a substantially vertical axis for rotation on guides on the outer surface of the drum. An inner crushing roller is mounted on the interior of the outer tube or drum, on an arm that holds the inner roller in a position so that its outer surface will engage the inner surface of the tube or drum. The inner roller is about one half the diameter of the outer drum. The arm is mounted on a hub, in turn mounted on a main support pivot pin. The hub supports a drive assembly including an arm for spring loading the inner roller against the inner surface of the drum or tube, a drive motor for the inner roller, and the inner roller, so that a single hub mounted on a single pin holds the inner roll, the drive and spring loading arm for the inner roller.

The inner crushing roller has wide ribs on its outer surface that provide a can gripping surface. In order to hold the cans properly in position until they are gripped in the "nip" between the inner crushing roller and the outer tubular drum, a simple, curved can guide extends in through the top of the tubular drum and extends down into an inlet space between the inner crushing roller and the outer drum. A can holddown shoe is provided over the upper portion of the can inlet opening to insure that the cans are properly guided so that they will be gripped for crushing.

The inner roller is powered from the motor and the surface of the inner roller grips the can to force the can into the nip formed between the outer surface of the inner roller and the inner surface of the outer drum. The inner roller is held against the inner surface of the drum under a light spring load when the can crusher is empty to reduce the likelihood of wear and to make the can gripping action easier. However, as soon as a can is gripped a heavier spring takes over to load the roller for crushing. The can is crushed as it passes between the mating surfaces of the inner roller and outer drum. As soon as the can exits the roller nip after being crushed it will drop through the open bottom of the outer tubular drum into a plastic bag or other container that is placed below the crusher.

The can crusher frame is made so that the crusher may be supported on a table top or bar top. The open bottom of the outer tubular drum will be positioned over suitable openings leading to a disposal container.

The unit is easily manufactured, low in cost, and is easily serviced because the motor, drive, chain, inner roller, and the can holddown guide all come off as a unit from a single post. The drive and crusher roller unit can easily be replaced merely by removing one bolt which holds a spring in position on the loading arm so that service people can easily take care of any problem back in the shop and merely replace the drive module used for the can crushing operation.

DETAILED DESCRIPTION OF THE PREFERRED EMBODIMENT

Figure 1:
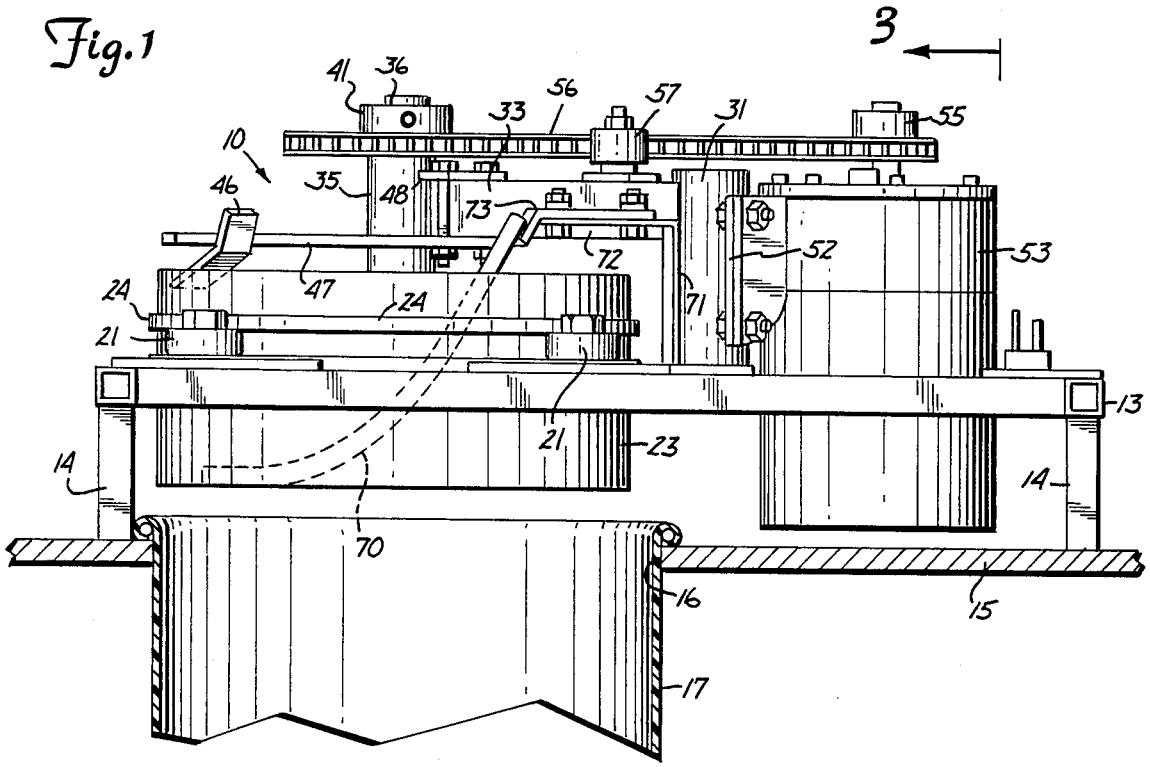
FIG. 1 is a side elevational view of a can crushing apparatus made according to the present invention.

A can crushing apparatus illustrated generally at 10 includes a frame 11 made up of parallel side rails 12, 12, and end rails 13 that are joined together by suitable welding. A midframe cross brace between the side rails also may be used. A plurality of legs 14 are fixed on the frame for supporting the can crushing apparatus on a table top or bar top indicated generally at 15. The legs 14 are short, as shown, and provide clearance for the components above the table top 15. The frame also can be supported within an outer housing if desired. An opening indicated generally at 16 is provided in table top 15 and a bag 17 or other container is aligned with the opening so that the cans can drop through the opening 16 and into the container. The container 17 can be supported in any desired manner and will have an open top for receiving the cans from the crusher.

The frame 11 has a plurality of gusset support plates (four of them as shown) indicated generally at 20 mounted thereon that in turn rotatably support bearings indicated at 21 using suitable cap screws 22 to hold the bearings in place. These bearings are sealed ball or roller type bearings that provide an outer surface for guiding a open end tubular drum 23. The bearings 21 are rotatably mounted about generally vertical parallel axes.

Figure 2:
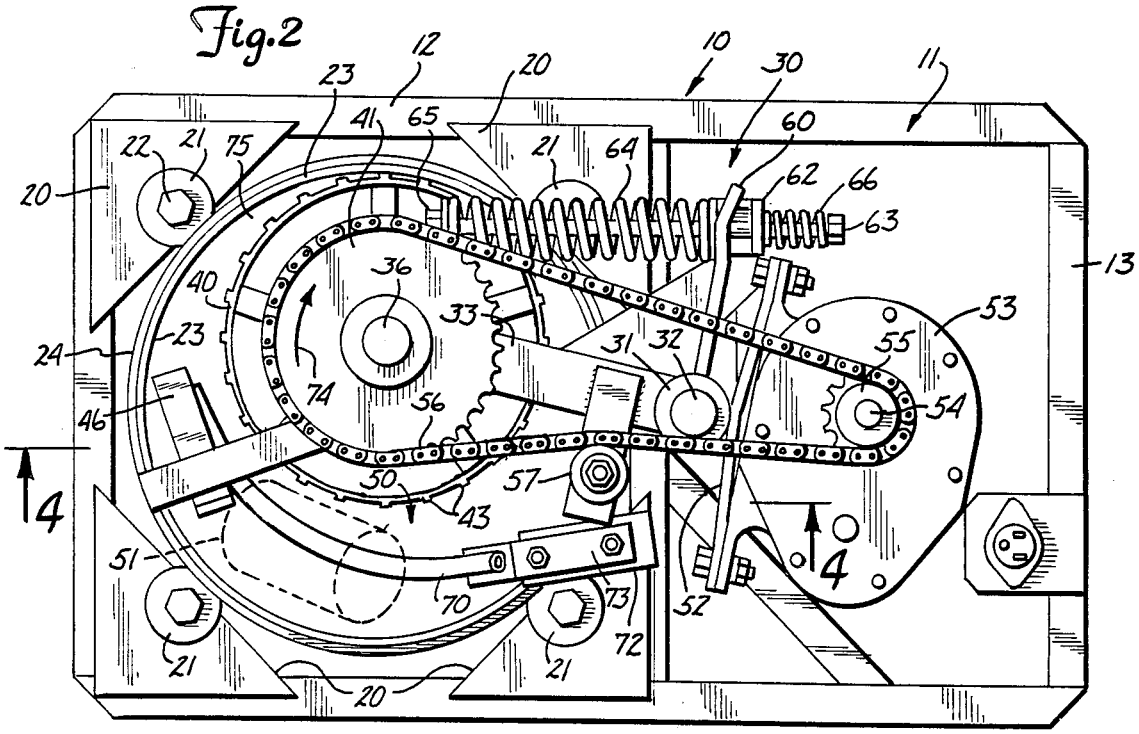
FIG. 2 is a top plan view thereof.
Figure 3:
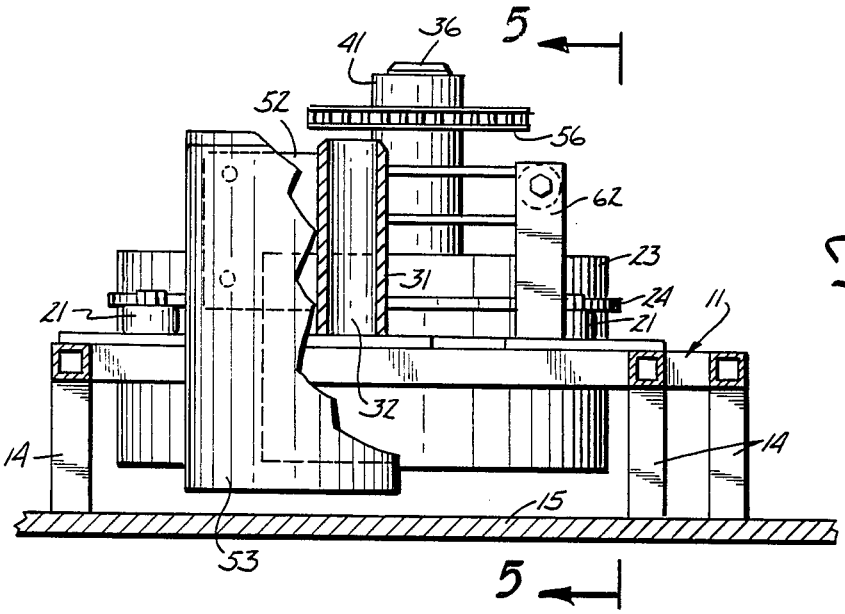
FIG. 3 is a fragmentary sectional view taken as on line 3—3 in FIG. 1, with parts in section and parts broken away.

The tubular drum 23 as shown fits between the gussets 20, and has a pair of vertically spaced annular ribs 24 positioned around the drum about midway along its length. The upper annular rib 24 rests on the upper edges or surfaces of the bearings 21, so that the drum 23 is supported in position for rotation as guided by the bearings about a vertical axis, parallel to the axes of rotation of the bearings 21. The lower rib 28 guides the drum and prevents it from being lifted up out of working position. In FIG. 2, it can be seen that the tubular drum 23 is positioned in an opening defined by the gussets or supports 20 within the framework 11.

The tubular drum 23 is merely a length of open ended tube, that is supported in position and freely rotatable on the bearings 21. The wall of the drum has a thickness adequate for crushing cans.

Figure 4:
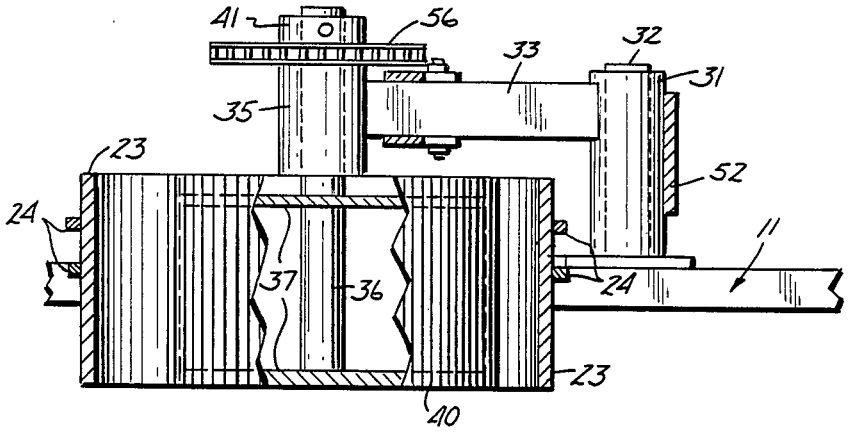
FIG. 4 is a fragmentary side view taken generally along line 4—4 in FIG. 2, with parts in section and parts broken away.
Figure 5:
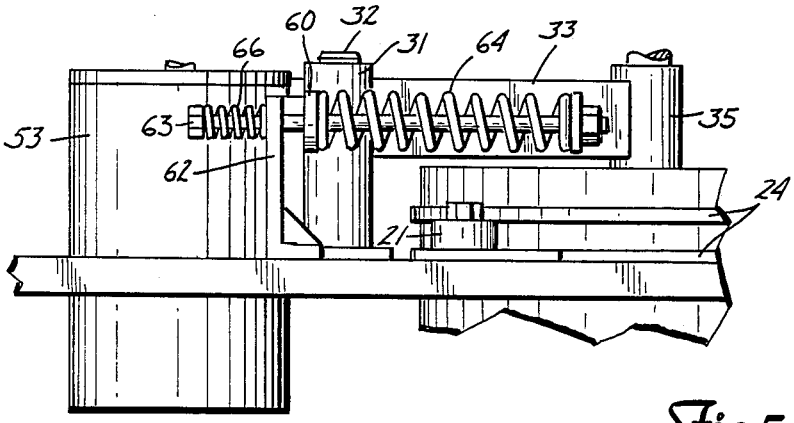
FIG. 5 is a side view taken from along line 5—5 in FIG. 3, again with parts in section and parts broken away.

The crushing apparatus comprises an assembly indicated generally at 30 that includes the drive motor, and the crushing roller. This assembly 30 comprises a main support hub 31 that is rotatably mounted or pivotally mounted on a shaft 32 which in turn is welded to a suitable support plate on the frame 11, and extends uprightly therefrom. The hub 31 has a main support arm 33 fixed thereto which extends laterally from the hub, and is positioned above the upper edge of the tubular drum 23, as perhaps best shown in FIGS. 2 and 4. The arm 33 at its end opposite from the hub 31 has a sleeve or hub 35 welded thereto, and this sleeve 35 is of suitable length so that it terminates about at the same level as the upper edge of the drum 23, as shown in FIG. 2.

The sleeve 35 in turn has suitable bushings or bearings for rotatably mounting a shaft 36. The shaft 36 in turn is welded to interior plates or webs indicated at 37 in FIG. 4 in the interior of a crushing roller 40. The crushing roller 40 thus is fixed to the shaft 36, and the shaft 36 extends up through the hub or housing 35. At the upper end of shaft 36 a drive sprocket 41 is drivably mounted on the shaft and pinned to the shaft. Thus, the weight of the drum 40 is supported on the arm 33, through the hub 35. If desired suitable thrust washers or bearings can be placed between the end of the sprocket hub on the upper end of the hub 35 for taking care of any friction caused by the rotation of the sprocket and the drum during operation.

The outer surface of the crushing drum 40 has spaced ribs 43 thereon with grooves in between. The ribs will tend to grip cans to be crushed and clamp them tightly so the cans will not be released. The crushing drum axis of rotation, which is the axis of shaft 36, is offset from the axis of tubular drum 23.

The arm 33 further supports a can holddown guide shoe 46 that is mounted on a support 47 which in turn is clamped on the arm 33 with a suitable pair of bolts and an upper clamping member indicated generally at 48 in FIG. 1. This can holddown guide extends laterally from the crushing drum 40 as shown in FIG. 1, and is positioned therefore above the upper edge of the tubular drum 23. The lower end portion of the can guide shoe 46 extends down into the interior of the outer drum 23 in the can input space indicated generally at 50 between the outer surface of the roller 40 and the inner surface of the drum 23. The space 50 is of size to permit a can indicated generally in dotted lines at 51 to fit between the drum inner surface and the outer surface roller 40 which has the ribs 43.

A motor support plate indicated at 52 is welded onto the hub 31, and mounts a motor-gear reducer assembly indicated generally at 53 of suitable design. This motor-gear reducer assembly is a normal 110 volt motor, that has an output shaft indicated at 54 which drives a sprocket 55. Because the arm 33 and the motor support plate 52 are both mounted on the hub 31. The pivot about the shaft 32 of the motor 53 and the drum that is in turn supported on hub 35. A chain indicated at 56 is used from the sprocket 55 to the sprocket 41 for driving the sprockets and thus the crushing roller 40. A suitable chain tightener indicated generally at 57 may be provided on the arm 33 for maintaining tension in the chain 56.

Additionally, the hub 31 has a loading arm indicated generally at 60 welded thereto and extending at substantially right angles to the direction of extension of the arm 33. Arm 60 aligns with a spring support bracket indicated generally at 61 which is fixed to the frame and has an upwardly extending leg 62 through which a spring bolt 63 extends. The spring bolt 63 passes through a provided opening in the arm 60, and a compression spring 64 is mounted over the spring bolt 63 on a side of the arm 60 so that the spring 63 will exert a force generally tending to urge the arm 60, hub 31, arm 33 and thus the roller 40 against the inner surface of the outer drum 23 (clockwise as shown in FIG. 2). In initial load, soft spring 66 is positioned between the upright leg 62 and the head of the bolt and provides a light load urging the roller surface against the drum. A suitable nut 65 on the end of the bolt 63 is used to adjust the springs so spring 64 is unloaded when no can is between the roller 40 and the inner surface of the drum. The spring 66 provides a light load to insure contact but not sufficient to cause excessive wear.

When a can is gripped by roller 40, the roller will pivot, compression spring 86 and the spring 66 almost immediately bottom out, after which heavy spring 64 (higher spring rate than spring 66) will load the roller 40 as the can is crushed.

Thus it can be seen that the entire assembly on the hub 31 includes the motor 53, the spring arm 60, the arm 33, and thus the roller 40 as well as the sprockets and drive chain, so that when service is required, lifting the hub 31 off the shaft 32 will lift the motor, crushing roller, sprockets, chain, and can holddown shoe as a unit for easy service. Of course the spring bolt 63 will have to be released from the arm 60 before lifting the assembly off.

Because the drum 23 is open bottomed, a curved can guide rod indicated generally at 70 is provided. Can guide rod 70 is supported on a bracket 71 that is welded onto a suitable support plate on the frame (one of the gussets 40). The bracket 71 is also "L" shaped, and has an upper horizontal leg 72 that supports a strap 73 that in turn holds the can guide rod 70. The can guide rod as shown curves downwardly into the interior of the drum 23, in the space indicated at 50, and provides a bottom support guide for a can to be crushed so that the can does not fall through the drum in this area. However, the pitch on the can guide is sufficient so that gravity will permit the can to slide along this rod and contact the inner surface of the drum 23 and the outer surface of the roller 40 and pass underneath the can holddown shoe. The can holddown shoe insures that the cans won't "squirt" upwardly as they start to be crushed.

As the motor 53 is powered in a normal manner and the roller 40 is being rotated under power in direction as shown by the arrow 74 in FIG. 2, the can or cans to be crushed will be moved into the nip of the roller indicated generally at 75. The roller 40, initially under a very light spring load, will move away from the inner surface of the drum easily to grip the can with ribs 43. The spring 66 permits adequate initial movement to insure that the can is gripped. The spring 66 then bottoms out and roller 40 is urged for crushing action by spring 64 which is substantially stiffer than spring 66. The roller 40 will yield as the can is crushed, but adequate crushing force is insured with spring 64. The cans are crushed as they pass between the inner surface of drum 23 and the roller 40 to the exit side on the opposite side of the roller 40. The crushed cans merely are dropped through the open bottom of the outer drum 23. The drum 23 is free to rotate as the cans are crushed as the drum is supported on the bearings 21.

The roller 40 is permitted to idle with low force from spring 66 on it so it does not wear, nor is drum 23 worn excessively.

The unit is thus relatively low cost to make, all of the working and powered components are easily accessible for service, and the open bottom of the drum 23 insures that the cans will be discharged freely once they are crushed so there is little chance that the cans will tend to stick or jam in the crusher.

It is essential that crushers that are used in individual locations operate in a fool-proof manner, and the present device accomplishes that.

Although the present invention has been described with reference to preferred embodiments, workers skilled in the art will recognize that changes may be made in form and detail without departing from the spirit and scope of the invention.

What is claimed is:

1. A machine for crushing cans comprising:

a support;

tubular drum means having an inner wall surface and being rotatably mounted on the support;

roller means having an outer surface;

means to mount the roller means on the interior of the tubular drum means with its outer surface in engagement with the inner wall surface of the drum means;

said means to mount including a support arm pivotally mounted on said support at a first end and the roller being rotatably mounted on the second end of said arm about an axis parallel to the axis of the tubular drum;

means for resiliently urging the outer surface of the roller means into engagement with the inner wall surface of the drum means without causing excessive wear on the outer surface of the roller means or the inner wall surface of the drum means and at an increased spring rate after the roller has moved away from the drum wall a selected distance; and a drive motor mounted to be movable with the support arm about the axis for driving said roller to crush cans introduced into the drum between the roller and inner wall surface of the drum.

2. A machine of claim 1 further comprising:

means for guiding cans to be crushed into the nip between the outer surface of the roller and the inner wall surface of the drum including a curved guide rod extending from the upper edge of the drum downwardly on the interior of the drum and an inner guide shoe overlying a portion of the guide rod.

3. The machine of claim 1 wherein said means to mount the roller comprises a hub to which said support arm is fixed, said support arm extending substantially radially from said hub, a motor mounted on said hub for supporting said drive motor, and a spring loading arm attached to said hub and extending laterally from said support arm, said means for resiliently urging comprising spring means acting against said spring loading arm and reacting loads to said frame, a pivot pin mounted on said frame and extending uprightly, said hub being rotatably mounted about said pivot pin to form the pivot of the roller, so that upon removal of said hub from said pin the roller, drive motor and the spring arm are removed simultaneously.

4. The machine of claim 1 wherein the outer surface of said roller has raised ribs for gripping a can to be crushed.

5. The apparatus as specified in claim 2 wherein said inner guide shoe is mounted on said arm and is removable with said arm.

6. The apparatus of claim 1 wherein said means for resiliently urging the outer surface of the roller means comprises a two stage spring means, including a first spring urging the roller means toward the drum means when no cans are present at a first spring load such that wear on the outer surface of said roller means and the inner wall surface of said drum means is minimized, and a second spring operable only after the roller means has moved away from the inner surface of the drum means a desired amount causing said first spring to bottom out.

7. The apparatus of claim 6 wherein the first spring has a substantially lower spring rate than the second spring.

8. The apparatus as specified in claim 1 wherein said outer driven drum is positioned in an opening in said frame, and bearing means mounted around the periphery of said drum to guide said bearing means for rotation about a central axis, rib means annularly positioned on said drum and supported on upper edges of said bearing means whereby the drum is free to rotate on said bearing means.

9. A rotary drum can crusher for crushing cans and discharging such crushed cans comprising a tubular drum having open ends, and having an axial length not greater than its diameter, said drum having an inner wall surface;

means to mount said drum for rotation about its axis;

a roller member of substantially smaller diameter than said drum, positioned within said drum;

a shaft mounted on said roller member and extending generally parallel to the axis of said drum, and upwardly above the upper edge of said drum;

a hub for rotatably mounting said shaft, and a sprocket drivably mounted on said shaft at the upper end of said hub;

said arm extending above the upper edges of said drum to outside of said drum;

a second hub mounted on the opposite end of said arm from said first hub;

a support shaft mounted on said frame and extending generally parallel to the axis of the drum, said second hub being pivotally mounted on said second shaft;

a motor mount plate mounted on said second hub;

a motor mounted on said motor mount plate, and having an output shaft drivably connected to said sprocket on said first mentioned shaft;

a loading arm fixed to said second hub and extending laterally therefrom;

means to exert a two stage spring load on said loading arm tending to rotate said second hub about said second shaft under a spring load;

said two stage spring load urging said roller against the inner surface of said drum on one side thereof, and yielding to permit cans to pass between the outer surface of said roller and the inner surface of said drum when cans are introduced into the nip of the roller; and a can guide means within said drum, to guide cans toward the nip of said roller, the open bottom of said drum permitting cans passing between said roller and the inner surface of said drum to drop downwardly under gravity.

10. The apparatus of claim 9 wherein the means to exert a two stage spring load forming a first low force spring urging the roller against the inner surface of the drum when the roller is contacted, such inner surface and second heavier spring operable only when the roller has moved away from the inner surface of the drum a desired amount.

11. The apparatus of claim 9 wherein said roller means has a plurality of ribs on the outer surface thereof for gripping cans to be crushed.

* * * * *